United States Patent [19]

Cimock

[11] Patent Number: 5,037,346

[45] Date of Patent: Aug. 6, 1991

[54] TOY FLASHLIGHT

[75] Inventor: Benjamin J. Cimock, Altamonte Springs, Fla.

[73] Assignee: I & K Trading Company, Vienna, Va.

[21] Appl. No.: 513,505

[22] Filed: Apr. 25, 1990

Related U.S. Application Data

[63] Continuation-in-part of Ser. No. 231,411, Aug. 12, 1988, abandoned.

[51] Int. Cl.[5] ..... A63H 5/00; A63H 33/26; G09F 19/00

[52] U.S. Cl. ..... 446/419; 446/485; 362/806; 362/808; 40/409; 40/410

[58] Field of Search ..... 446/419, 418, 421, 219, 446/242, 267, 153, 485; 362/173, 182, 186, 806, 808, 811; 40/409, 410, 442, 444

[56] References Cited

U.S. PATENT DOCUMENTS

| | | | |
|---|---|---|---|
| 1,460,644 | 7/1923 | Dollison et al. | 362/293 X |
| 2,085,207 | 6/1937 | Abramson | 362/808 X |
| 2,197,637 | 4/1940 | Goldberg | 362/293 X |
| 2,330,673 | 9/1943 | Braum | 362/207 X |
| 2,459,555 | 1/1949 | Tossas | 446/219 |
| 2,470,612 | 5/1949 | Galter | 362/186 X |
| 2,623,934 | 12/1952 | DeBow et al. | 362/293 X |
| 2,695,355 | 11/1954 | Giusto | 362/186 |
| 2,751,490 | 6/1956 | Emerson | 362/208 |
| 2,760,185 | 8/1956 | Held | 362/293 X |
| 2,959,892 | 11/1960 | Johnson | 446/421 |
| 2,983,812 | 5/1961 | Ashe | 362/186 |
| 3,383,675 | 5/1968 | Allardice et al. | 362/186 X |
| 3,391,935 | 7/1968 | Gross | 446/485 X |
| 3,791,068 | 2/1974 | Pietrowiak | 446/485 X |
| 3,877,171 | 4/1975 | Sloop et al. | 446/485 |
| 4,170,035 | 10/1979 | Walker | 362/806 X |
| 4,208,701 | 6/1980 | Schock | 446/485 X |
| 4,291,365 | 9/1981 | Tandon et al. | 362/208 X |
| 4,600,974 | 7/1986 | Lew et al. | 446/485 X |
| 4,697,228 | 9/1987 | Mui et al. | 362/208 X |
| 4,858,079 | 8/1989 | Ohashi | 84/95.2 X |
| 4,858,083 | 8/1989 | Wakimoto | 362/806 X |

FOREIGN PATENT DOCUMENTS

| | | | |
|---|---|---|---|
| 2199256 | 7/1988 | United Kingdom | 446/485 |
| 2221626 | 2/1990 | United Kingdom | 446/219 |

*Primary Examiner*—Robert A. Hafer
*Assistant Examiner*—D. Neal Muir
*Attorney, Agent, or Firm*—Blum Kaplan

[57] ABSTRACT

A toy flashlight includes a color filter assembly that is releasably mounted to a handle housing and contains at least two distinct color filters. Light beams are transmitted through the colored filters. A globe is included as part of the color filter assembly and includes reflective objects in a variety of colors and shapes therein. By moving the flashlight, color beams of light are scattered off the reflective objects to provide a random color light display.

8 Claims, 4 Drawing Sheets

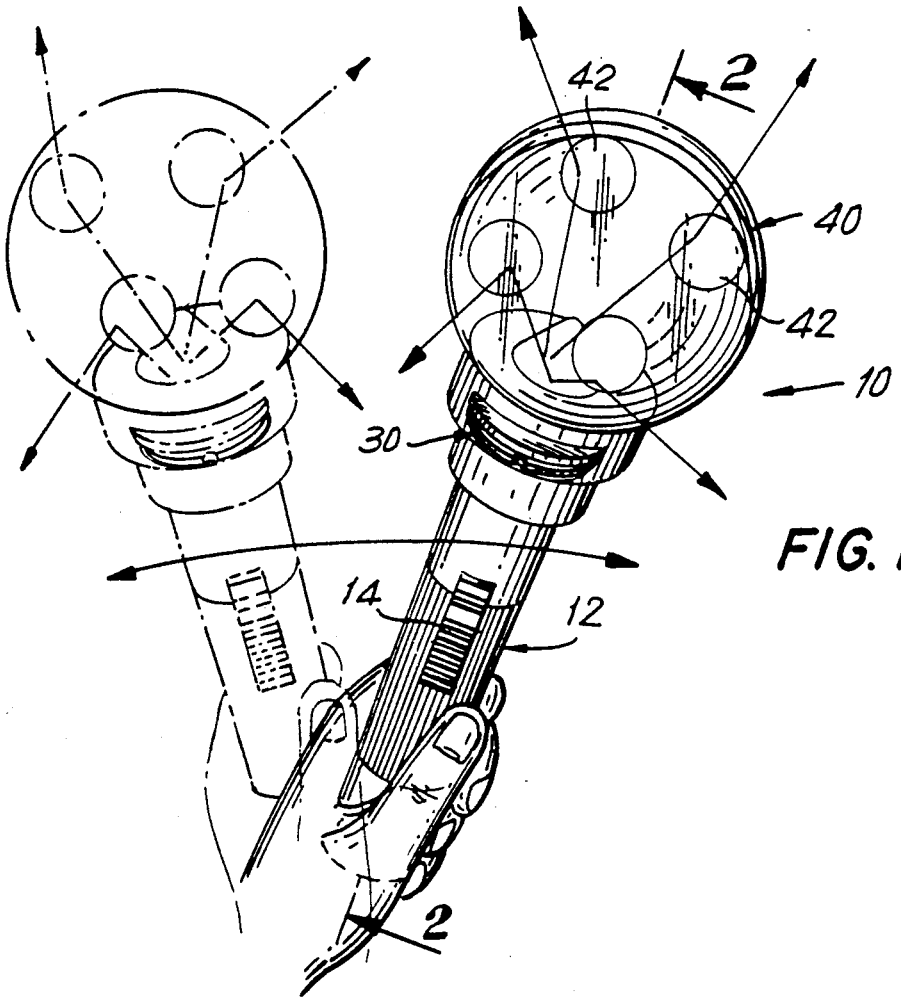
FIG. 1
FIG. 3
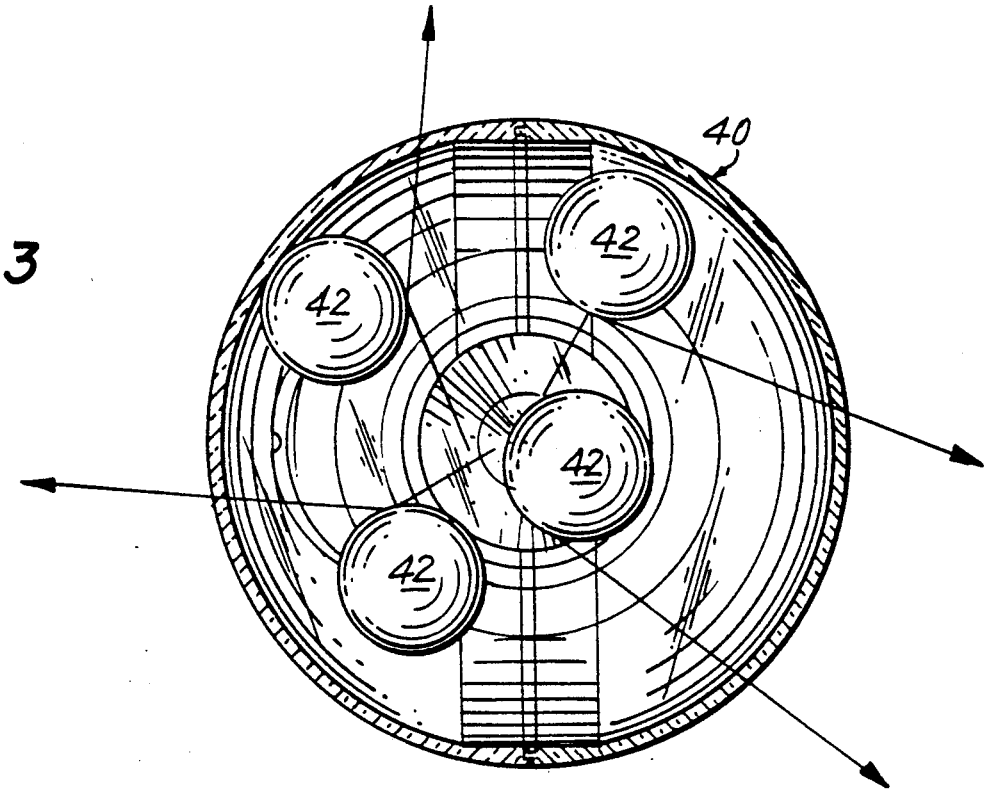

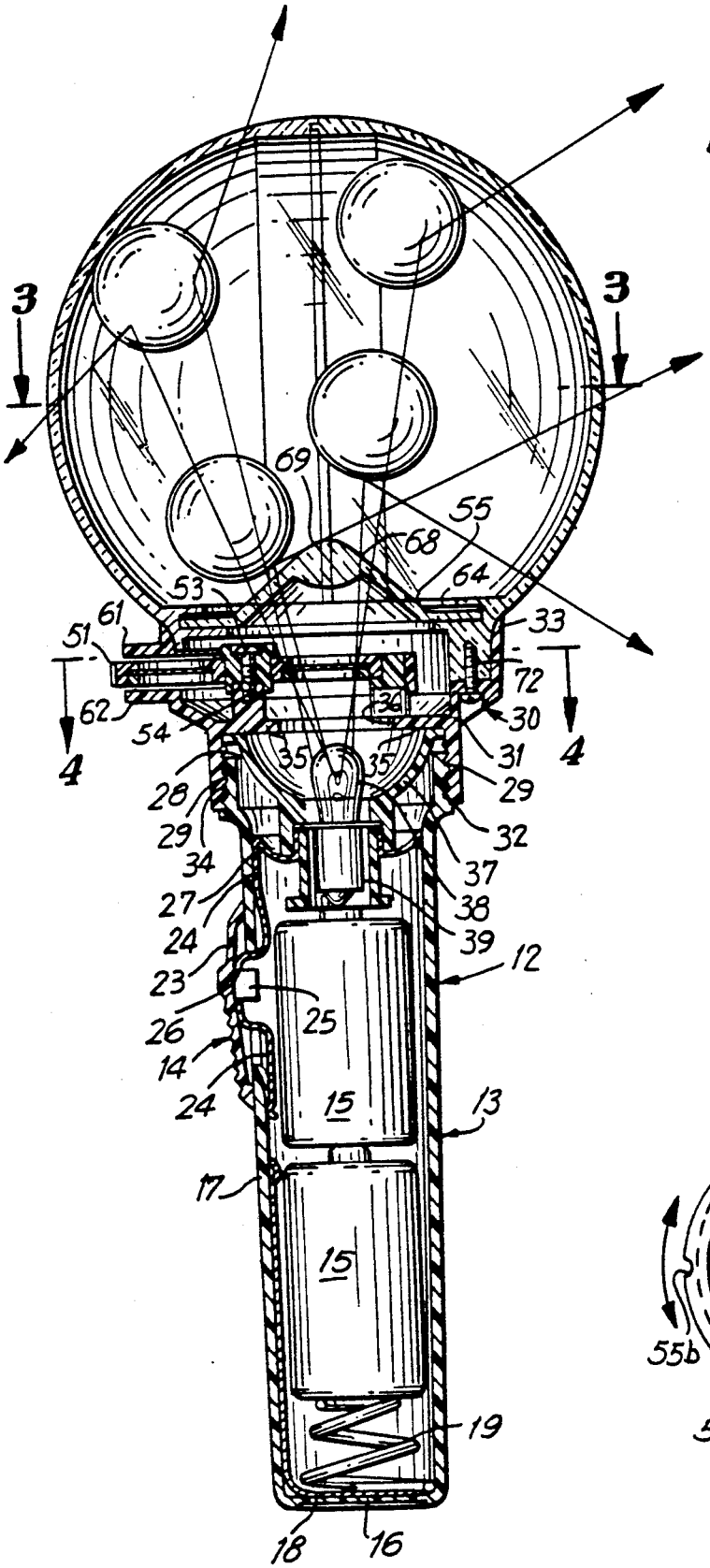
FIG. 2
FIG. 4
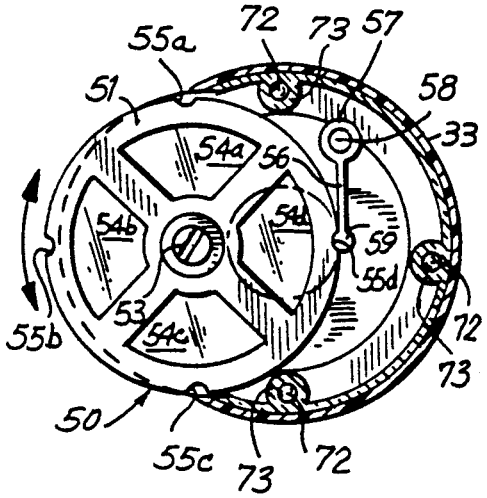

TOY FLASHLIGHT

CROSS-REFERENCE TO RELATED APPLICATION

This application is a continuation-in-part application of pending U.S. Ser. No. 07/231,411 filed on Aug. 12, 1988, and entitled TOY FLASHLIGHT now abandoned.

BACKGROUND OF THE INVENTION

This invention is directed to a novel amusement device and, in particular, to a toy flashlight that emits light of different colors and provides distinct types of play value.

Over the years, flashlights have been used for a variety of purposes. One such purpose is as an amusement device for capturing the imagination of children. Although children will use a flashlight as a toy, the novelty of a standard flashlight will wear off quickly due, in large measure, to the absence of uses that are meaningful to a child. Toy manufacturers have developed several modifications of household flashlights. One such flashlight is disclosed in U.S. Letters Patent No. 3,877,171.

However, it is known that children enjoy toys that contain colors, make noises and can be used for a variety of different games. These type of toys allow a child to use his imagination and create games from a single device. Accordingly, an improved toy flashlight that emits color, sound and light and, hence, provides enhanced play value is desired.

SUMMARY OF THE INVENTION

Generally speaking, in accordance with the instant invention, a toy flashlight is provided. The toy flashlight includes a handle housing for receiving a power supply. A light source is mechanically mounted to the handle housing and is adapted to be electrically coupled to the power supply for the purpose of selectively emitting a beam of light. A filter mechanism is supported by the handle housing. The filter mechanism contains at least two distinct color filters. A transparent enclosure is mounted to the handle housing so that light is emitted through either the first or second color filter to permit distinct colored light to be emitted through the transparent enclosure.

A plurality of opaque objects in a variety of colors and shapes are disposed in the transparent enclosure. In a preferred embodiment, the objects are silver and gold shaped moons and stars. A movement of the handle housing causes the opaque objects to move in a random direction thereby causing the colored light to be reflected and scattered in a multiplicity of directions.

Accordingly, it is an object of the instant invention to provide an improved amusement device in the form of a toy r flashlight.

A further object of the instant invention is to provide an amusement device which enables a child to have a lighting toy which can provide distinct colors, shapes, generates sounds and provides a distinct play value.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompany drawings, in which:

FIG. 1 is a perspective view of a flashlight constructed in accordance with the preferred embodiment;

FIG. 2 is a sectional view taken along line 2—2 of the toy flashlight of FIG. 1;

FIG. 3 is a sectional view taken along line 3—3 of FIG.

FIG. 4 is a sectional view taken along line 4—4 of FIG.

DETAILED DESCRIPTION OF THE PREFERRED EMBODIMENTS

Figure 5:
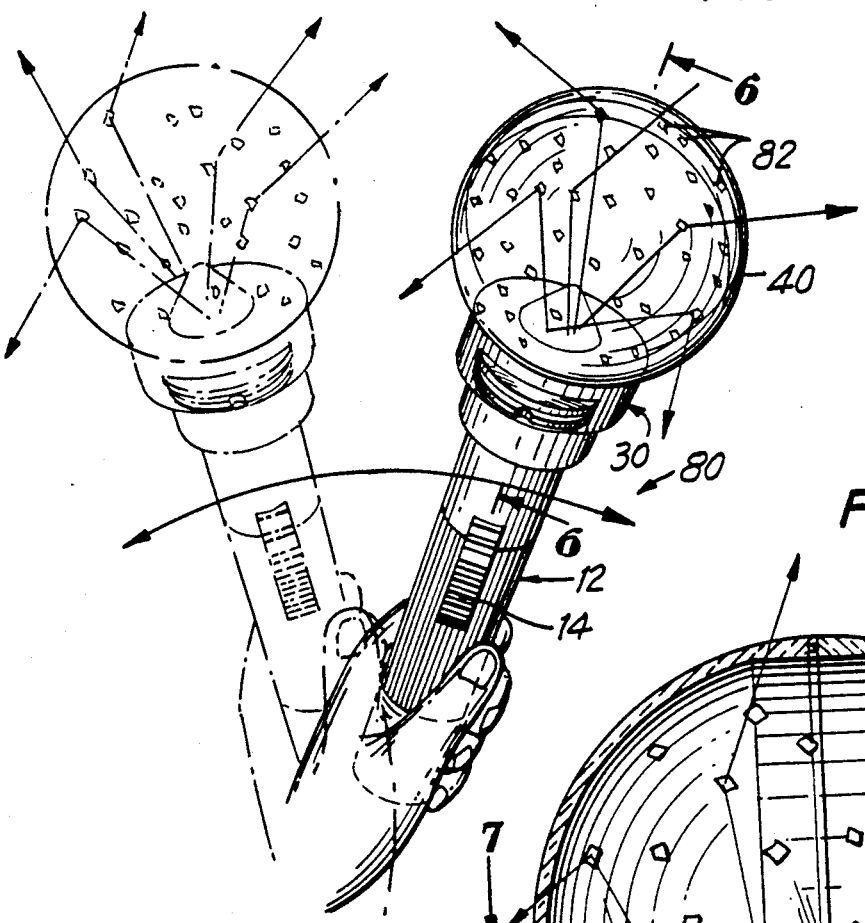
FIG. 5 is a perspective view of a toy flashlight constructed in accordance with a further embodiment of the instant invention.

Reference is first made to FIG. 1, wherein a toy flashlight, generally indicated as 10, is depicted. Flashlight 10 includes a handle assembly 12 including a displaceable on-off switch assembly generally indicated as 14. Handle assembly 12 supports a filter housing assembly generally indicated as 30, which assembly supports a transparent globe 40 having translucent or opaque balls 42 disposed therein.

Referring now to FIGS. 1-4, handle assembly 12 includes a cylindrical housing 13 for receiving and positioning therein batteries 15. In particular, handle housing 13 includes an end wall 16 and a cylindrical wall 17. A lead plate 18 is disposed against the inside of end wall 16 and extends along cylindrical wall 17 to the switch assembly 14. A conductive spring 19 is disposed against lead plate 18 to position the batteries 15 in the housing and couple the negative terminal of battery 15 to the lead plate 18.

Switch assembly 14 is conventional and includes a switch plate 23 and an elongated bent conductive lead 24 secured thereto by inserting a projection 25 on switch plate 23 into an opening 26 in conductive lead 24. Conductive lead 24 includes a contact portion 27 which extends toward the open end 28 of the cylindrical housing 13. At the open end 28 of the cylindrical housing 17 are threads 29 angularly disposed about the open end of housing for releasably receiving filter assembly 30.

Filter assembly 30 includes a housing 31 having a light bulb supporting wall 32 and a filter supporting wall 33. Bulb support wall 32 includes threads 34 on the inner surface thereof to permit filter assembly 30 to be releasably secured to housing 13. An inwardly radially disposed wall 35 having an opening 36 therein is adapted to support a conductive light bulb reflector 37, which reflector is adapted to secure therein a conventional flashlight bulb 38. In an alternative embodiment, flashlight bulb 38 is a focus light bulb. The focus bulb focusses the beam light thereby increasing the light that reflects against the objects in the globe 40. Seated in the reflector 37 and holding bulb 38 in position is a collar 39, which extends into handle housing 13 and positions the bulb in contact with positive terminal of battery 15 in a conventional manner.

Accordingly, bulb 38 is maintained in electrical contact with conductive reflector 37 and is also in electrical contact with the positive terminal of battery 15. When switch 14 is moved in the direction of globe 40, contact portion 27 of lead 24 is placed in electrical contact with reflector 37 to define a closed circuit, thus turning on the light 38 in a conventional manner.

Referring specifically to FIGS. 3 and 4, filter supporting wall 33 supports therein a filter assembly, generally indicated as 50. Filter assembly 50 includes a color wheel 51 that is rotatably mounted to support wall 33 by a screw 53 anchored into a threaded opening 54 Color wheel 53 includes four panels 54*a*, 54*b*, 54*c* and 54*d*, each formed of a translucent or transparent material for permitting light of different colors to be projected toward globe 40 In an exemplary embodiment, panel 54*a* is red, panel 54*b* is yellow, panel 54*c* is blue and panel 54*d* is green. However, one of these panels could be transparent or of any other color.

Color wheel 51 includes four notches 55*a*, 55*b*, 55*c* and 55*d*, each of which correspond to panels 54*a*, 54*b*, 54*c* and 54*d*, respectively. Notches 55*a*, 55*b*, 55*c* and 55*d* cooperate with indexing lever 56 to position the color wheel at one of four positions so that the color panels are in alignment with bulb 38. Indexing lever 56 includes a collar 57 which is interference fit on a post 58 that is formed on support wall 33. Indexing lever 56 also includes a rounded indexing projection 59. Projection 59 should be either round, cylindrical or tear-dropped to permit projection 59 to easily ride into and out of notches 55*a*, 55*b*, 55*c* and 55*d* when color wheel 51 is rotated.

In order to facilitate rotation of color wheel 51, color wheel 51 is positioned off center with respect to the axis of the cylindrical handle housing 17 and projects through upper and lower walls 61 and 62, respectively. Accordingly, color wheel 51 projects beyond walls 61 and 62 to permit a thumb to be used to rotate the color wheel and index the wheel to one of the four positions defined by notches 55*a* through 55*d* and the indexing lever 56.

At the end of the housing 33 that connects with globe 40 is a cylindrical wall 66 that supports an inwardly directing wall 64 defining an opening 65. A lens 68 is secured against wall 64 and projects into opening 68. Lens 68 includes projecting dome 69 that radiates the light throughout the globe 40. Also, within dome 69, at the apex thereof, the thickness is increased at 70 to assure that additional light is diffused thereby. Finally, globe 40 is secured to housing wall 33 by screws 72 which are inserted into threaded blind holes 73 molded into the globe 40 to permit the globe to be anchored to the filter housing 33.

In a first embodiment illustrated in FIGS. 1 through 4, balls 42 are placed in globe 40 before the globe is anchored to filter housing 33. In a preferred embodiment, balls 42 are made of an iridescent plastic resin that is reflective.

In operation, balls 42 cause toy flashlight 10 to make noise when the flashlight is moved around. Also, by turning on the light by displacing on-off switch 14 to an on position, the light emanating from the globe is randomly scattered by the balls in the dome. Thus, the scattering of light off the balls 42 causes a random light scattering effect that provides still additional play value.

Also, by rotating color wheel 51, a third play value is obtained, namely different colors of light can be selected. Thus, when turned on, and when a particular color such as red is selected, the red color will emanate from the globe and will be scattered by balls 42 in a random fashion.

Figure 6:
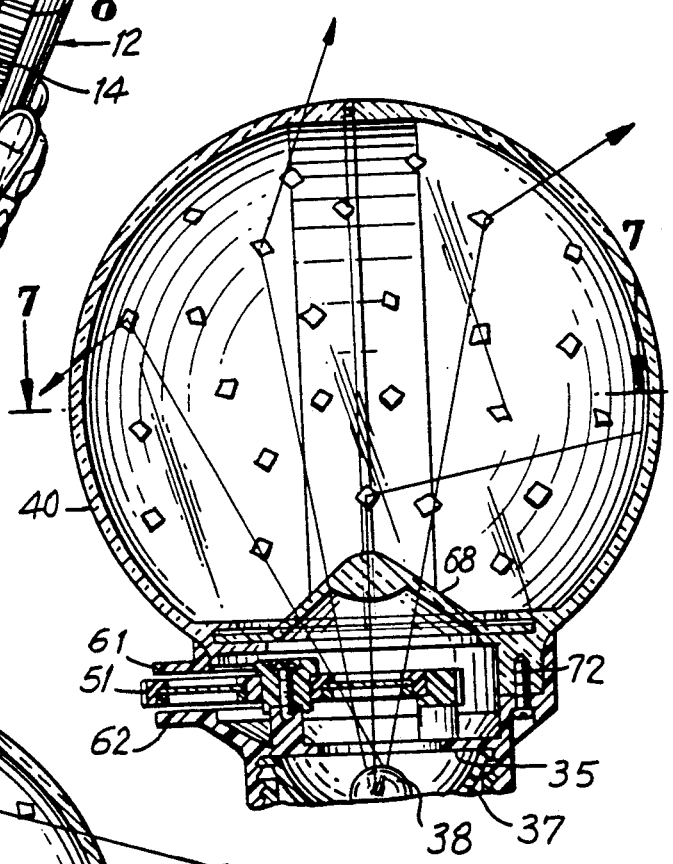
FIG. 6 is a sectional view taken along line 6—6 of FIG.
Figure 7:
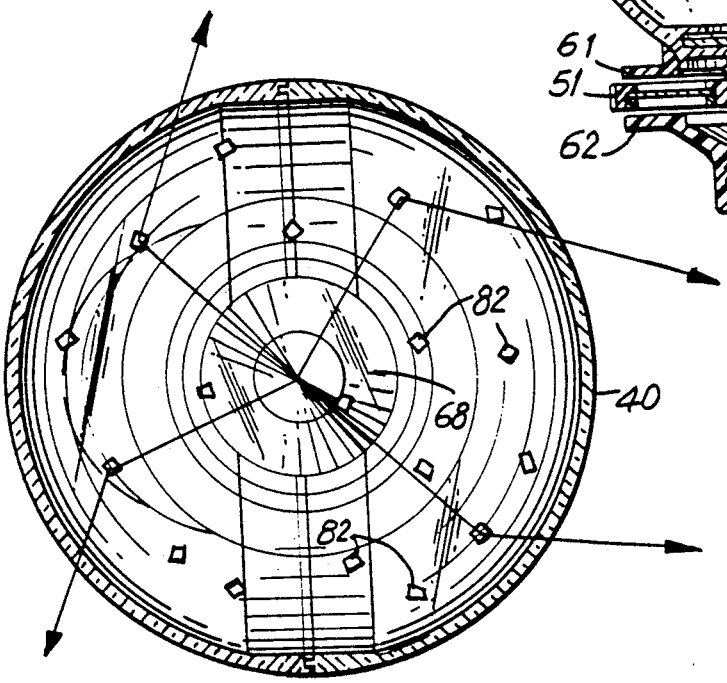
FIG. 7 is a sectional view taken along line 6—6 of FIG.

Reference is now made to FIGS. 5 through 7 wherein an alternate embodiment of the toy flashlight of the instant invention, generally identified as 80, is depicted. The only difference between the embodiment depicted in FIGS. 5 through 7 and the embodiment depicted in FIGS. 1–4 is the replacement of balls 42 with MYLAR® chips 82 having a dimension on the order of ¼" square. The shape of chips 82 can be square, trapezoidal, round or otherwise and can be die cast from sheets of MYLAR®. The chips cause the colored light beams 32 to reflect in a greater amount of directions in a faster and more random manner. In all other respects, the embodiment of FIGS. 5 through 7 are identical to the embodiment of FIGS. 1 through 4, and like reference numerals are utilized to denote like elements.

Figure 8:
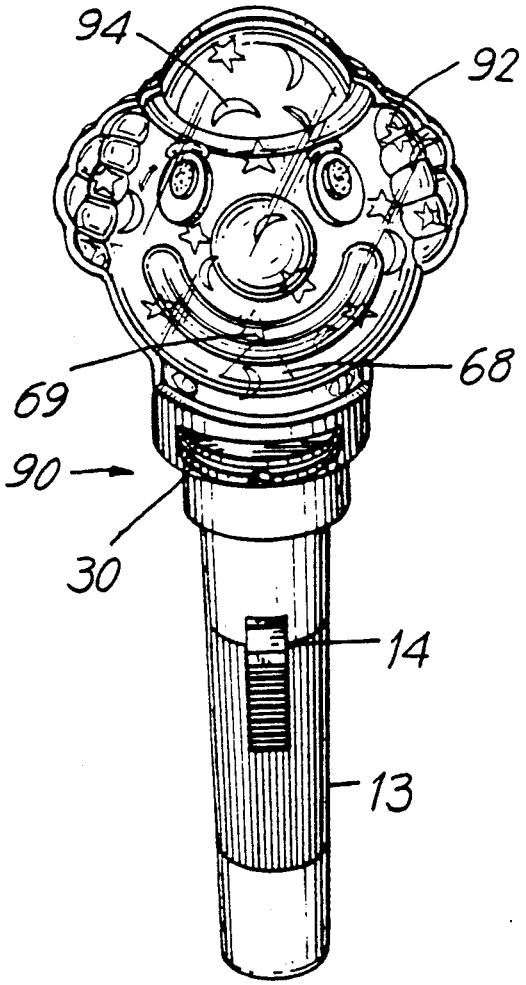
FIG. 8 is a perspective view of a toy flashlight constructed in accordance with still a further embodiment of the instant invention.

Referring to FIG. 8, still another embodiment is generally shown as 90. The only difference between the embodiment depicted in FIGS. 1–4 and the embodiment depicted in FIGS. 5–7 with that of the new embodiment is the replacement of balls 42 and MYLAR® chips 82 with MYLAR® objects of a variety of colors and shapes. In the preferred embodiment, the objects are silver and gold shaped moons 94 and stars 96. The silver and gold moons 94 and stars 96 continue to cause the colored light beams 32 to reflect therefrom. In addition, the colors and shapes provide added light dispersion by toy flashlight 90. Further, globe 40 in the embodiments previously disclosed is shaped in the form of a head 92 as shown in the embodiment of FIGS. 8.

Accordingly, the instant invention is characterized by a toy flashlight that is capable of imparting several distinct types of play value. In a first embodiment, scattered light of different colors and a noisemaker is provided. In a second embodiment, scattered light in different colors is rapidly and more randomly dispersed. In a third embodiment, the addition of a variety of colors and shapes to the objects within the globe enhances the color dispersion while maintaining the rapid movement of the objects.

It will thus be seen that the objects set forth above, among those made apparent from the preceding description, are efficiently attained and, since certain changes may be made in the above construction without departing from the spirit and the scope of the invention, it is intended that all matters contained in the above description or shown in the accompanying drawings shall be interpreted as illustrated and not in a limiting sense.

It is also understood that the following claims are intended to cover all of the generic and specific features of the invention herein described and all statements of the scope of the invention which, is a matter of language, might be said to fall therebetween.

What is claimed is:

1. An amusement device comprising handle means for receiving a power supply therein, light source means releasably mounted to said handle means for emitting a beam of light, filter means mounted to said handle means, said filter means being adapted to permit at least two distinct color lights to be transmitted therethrough and including a plurality of colored panels, said filter means being rotatably supported by said handle means and extending out of the handle means to be manually accessible to permit said panels to be manually selectively positioned in the path of the beam of light emitted by said light source means to select a preferred color, and a transparent enclosure covering said light source means and said filter means and being filled with air, said air being the only enclosed liquid therein so that light transmitted through said transparent enclosure is colored by said filter means and a plurality of light reflecting objects having at least one specified color and at least one specified shape are positioned in said transparent enclosure and said reflecting objects deflect said emitted light in a plurality of directions by means of vigorously randomly moving said device in a multiplicity of directions so that the light reflecting objects come to rest rapidly when said vigorous random motion ceases.

2. An amusement device as claimed in claim 1, wherein said handle means is comprised of a housing containing a power supply located within said handle means connecting a light bulb and switching means engaging said power supply to said light bulb for controlling the illumination from said light source.

3. An amusement device as claimed in claim 1, wherein said filter means includes an indexing mechanism for positioning said colored filter panels.

4. An amusement device as claimed in claim 1, wherein said objects are silver and gold shaped moons and stars, said moons and stars being adapted to move around and in response to random movement of said amusement device.

5. An amusement device as claimed in claim 1, wherein said objects are flat particles cut from sheets, said particles being opaque.

6. An amusement device as claimed in claim 5, wherein said objects are particles cut from a sheet, said particles having a reflective surface.

7. An amusement device as claimed in claim 1, wherein said transparent enclosure is in the form of a doll's head to provide additional play value.

8. An amusement device, as claimed in claim 1, wherein said transparent enclosure is defined by a shape that includes nonregular curves and angles in the surface of the enclosure.

* * * * *